US005757344A

United States Patent [19]

Miyata et al.

[11] Patent Number: 5,757,344

[45] Date of Patent: May 26, 1998

[54] COLD CATHODE EMITTER ELEMENT

[75] Inventors: Koichi Miyata; Kozo Nishimura; Koji Kobashi, all of Kobe, Japan

[73] Assignee: Kabushiki Kaisha Kobe Seiko Sho, Kobe, Japan

[21] Appl. No.: 953,847

[22] Filed: Sep. 30, 1992

[30] Foreign Application Priority Data

Sep. 30, 1991 [JP] Japan ..... 3-280518
May 11, 1992 [JP] Japan ..... 4-117521

[51] Int. Cl.[6] ..... H01J 1/14

[52] U.S. Cl. ..... 345/75; 313/311; 445/50

[58] Field of Search ..... 313/309, 310, 313/311, 336, 308; 445/24, 50; 428/195; 315/169.3, 169.1; 257/10, 11, 77; 345/74, 75; 437/22, 39

[56] References Cited

U.S. PATENT DOCUMENTS

| | | | |
|---|---|---|---|
| 4,143,292 | 3/1979 | Hosoki et al. . | |
| 4,164,680 | 8/1979 | Villalobos . | |
| 4,929,489 | 5/1990 | Dreschhoff et al. | 428/195 |
| 5,010,249 | 4/1991 | Nishikawa . | |
| 5,030,583 | 7/1991 | Beetz, Jr. | 437/39 |
| 5,099,296 | 3/1992 | Mort et al. | 357/22 |
| 5,129,850 | 7/1992 | Kane et al. . | |
| 5,131,963 | 7/1992 | Ravi | 47/974 |
| 5,138,237 | 8/1992 | Kane et al. | 313/308 |
| 5,141,460 | 8/1992 | Jaskie et al. | 313/309 |
| 5,180,951 | 1/1993 | Dworsky et al. | 315/169.3 |
| 5,189,341 | 2/1993 | Itoh et al. | 315/169.1 |
| 5,202,571 | 4/1993 | Hirabayashi et al. | 257/10 |
| 5,283,501 | 2/1994 | Zhu et al. | 315/169.3 |
| 5,373,172 | 12/1994 | Kobashi et al. | 257/77 |

FOREIGN PATENT DOCUMENTS

| | | |
|---|---|---|
| 0 481 419 | 2/1992 | European Pat. Off. . |
| 0 481 419 A2 | 4/1992 | European Pat. Off. . |
| 0 528 390 A1 | 8/1992 | European Pat. Off. . |
| 0 523 494 A1 | 1/1993 | European Pat. Off. . |
| 0 528 322 A1 | 2/1993 | European Pat. Off. . |
| 0 528 391 A1 | 2/1993 | European Pat. Off. . |
| 62-0140332 A | 6/1987 | Japan . |
| 2 237 145 | 4/1991 | United Kingdom . |

OTHER PUBLICATIONS

"Diamond Cold Cathode," IEEE Electron Device Letters, vol. 12, No. 8, Aug. 1991, M. W. Geis et al., pp. 456–459.

"Quantum photoyield of diamond(111)–A stable negative–affinity emitter," Physical Review B, vol. 20, No. 2, Jul. 15, 1979, F. J. Himpsel, et al., pp. 624–627.

"Cold Field Emission From CVD Diamond Films Observed in Emission Electron Miroscopy," Electronics Letters, vol. 27 No 9. 16, Aug. 1, 1991, C. Wang, et al., pp. 1459–1461.

"Vacuum Microelectronics", Applied Physics, vol. 59, No. 2, 1990.

Patent Abstracts of Japan, JP–A–4–67528, Mar. 3, 1992, Keiji Hirabayashi, et al., "Semiconductor Electron Emitting Element".

Patent Abstracts of Japan, JP–A–62–140332, Jun. 23, 1987, Shigeyuki Hosoki, et al., "Field Emission Cathode".

*Primary Examiner*—Steven Saras

*Attorney, Agent, or Firm*—Oblon, Spivak, McClelland, Maier & Neustadt, P.C.

[57] ABSTRACT

Disclosed is planar and vertical cold cathode emitter elements including an semiconducting diamond emitter portion having a high thermal resistance and a high breakdown voltage, thereby suppressing the deterioration of the electron emission characteristics and enabling the operation with a high electric power.

6 Claims, 9 Drawing Sheets

COLD CATHODE EMITTER ELEMENT

BACKGROUND OF THE INVENTION

1. Field of the Invention

The present invention relates to cold cathode emitter elements applicable for vacuum elements utilizing vacuum microelectronics such as rectifier elements, amplifier elements and display elements.

2. Description of the Related Art

Techniques of fabricating micro-vacuum elements in micron-sizes have been researched and developed using microfabrication techniques employed in the fabrication of semiconductor transistors and the like. This is disclosed in Ōyō-Butsuri (Applied Physics), Vol. 59, No. 2, 1990 (Junji Ito, "Vacuum Microelectronics").

FIG. 12 is a cross-sectional view of a typical vacuum triode element as one of the above vacuum elements. In the figure, an insulating film 33 with a pinhole is selectively deposited on a silicon substrate 31. A conical emitter 32 is formed inside the pinhole. A gate electrode 34 is deposited on the insulating film 33 around the pinhole, and an anode electrode 35 is deposited outside the gate electrode 34.

The above vacuum triode element is placed in vacuum, and then the emitter 32, the gate electrode 34 and the anode 35 are applied with the specified voltages, respectively. Consequently, electrons are emitted from the tip of the emitter 32 into vacuum, travelling along the trajectory shown as the arrow in FIG. 12, and reach the anode 35. In this vacuum triode element, since electrons move in vacuum, the electron velocities can be approximately 1000 times faster than electrons in solid (for example, in semiconductor transistors or the like). Therefore, in the rectifier elements, transistors and the like using the cold cathode emitter, ultra-high speed operation is possible. Also, an optical display can be made by disposing electron emitters oppositely to a fluorescent screen.

FIGS. 13*a*, 13*b* and 13*c* are cross-sectional views showing a method for fabricating the cold cathode emitter element of Mo in the order of the processes. As shown in FIG. 13*a*, an insulating film 33 (for example, a $SiO_2$ film), a Mo film 36 and an Al film 37 are sequentially deposited on a substrate 31, and a pinhole extending from the surface of the Al film 37 to the surface of the substrate 31 is formed. Then, Mo is vacuum-evaporated on the whole surface as shown in FIG. 13*b*. Mo is deposited both in a cone-shape on the silicon substrate 31 inside the pinhole and on the Al film 37 so as to close the pinhole. Namely, with the increase in the thickness of the Mo film 38 deposited on the Al film 37, the diameter of the pinhole is decreased and finally the pinhole is closed. As a result, a conical emitter 32 made of Mo is formed on the substrate 31 inside the pinhole. The Mo film 38 and the Al film 37 are subsequently removed, as shown in FIG. 13*c*. Thus the cold cathode emitter element of Mo is obtained.

FIGS. 14*a*, 14*b* and 14*c* are cross-sectional views showing another method for fabricating the cold cathode emitter element of Si in the order of the processes. As shown in FIG. 14*a*, a mask 39 made of such a material as $SiO_2$ or SiN is selectively formed on the (100) face of a silicon substrate 31. Subsequently, as shown in FIG. 14*b*, anisotropic etching is carried out on the silicon substrate 31 using an etchant (a mixed solution of KOH, isopropylalcohol (IPA) and $H_2O$). Consequently, an emitter 32 made of Si is formed under the mask 39. As shown in FIG. 14*c*, after the mask 39 is removed, an insulating film 33 is formed around the emitter 32, and a leading electrode 40 is formed on the insulating film 33. Thus, the cold cathode emitter element of Si can be made.

FIG. 15 is a cross-sectional view of a conventional vertical vacuum triode element with an open cavity using a field emission emitter. In the emitter element shown in FIG. 12, the gate electrode 34 and the anode 35 are disposed around the emitter 32 in a two-dimensional fashion. By contrast, in the vertical vacuum triode element shown in FIG. 15, the gate electrode 34 and the anode 35 are disposed in a three-dimensional fashion through the insulating film 33.

FIGS. 16*a* to 16*e* are cross-sectional views showing a method for fabricating the vertical vacuum triode element shown in FIG. 15 in the order of the processes. As shown in FIG. 16*a*, an insulating film 33 (for example, a SiN film) is formed on the (100) face of a silicon substrate 31 to a thickness of, for example, 4 μm. A photoresist film 41 is selectively formed on the insulating film 33, and then the insulating film 33 is partially removed using the photoresist film 41 as a mask (see FIG. 16*b*). Subsequently, anisotropic etching is carried out on the silicon substrate 31 using the insulating film 33 as a mask (see FIG. 16*c*). Thus, a conical emitter 32 can be obtained. An insulating film 42 (for example, a $SiO_2$ film) is then formed on the whole surface, and further an electrode film 43, an insulating film 44 (for example, a $SiO_2$ film) and an electrode film 45 are sequentially formed (see FIG. 16*d*). In FIG. 16*e*, the insulating film 42, the insulating film 33, the electrode film 43, the insulating film 44 and the electrode film 45 formed on the emitter 32 are selectively removed. Thus, the vertical triode element can be obtained.

However, as mentioned above, in the conventional cold cathode emitter elements, silicon, tungsten, or molybdenum is generally used as a material constituting the emitter. As a result, during the operation of the emitter element, the curvature of the tip of the emitter becomes larger, or the surface thereof is oxidized due to the heat generated, which causes rapid deterioration of the electron emission characteristics. Therefore, the conventional emitter elements cannot provide the longer life and the resistance against a high electric power operation, and therefore, is difficult for practical use.

SUMMARY OF THE INVENTION

An object of the present invention is to provide cold cathode emitter elements capable of suppressing the deterioration of electron emission characteristics and of being operated with a high electric power.

In a preferred mode of the present invention, there is provided a cold cathode emitter element comprising an emitter portion for electron emission from the surface thereof into vacuum, wherein the emitter portion is made of a semiconducting diamond.

BRIEF DESCRIPTION OF THE DRAWINGS

These and other objects of the present invention will be seen by reference to the description taken in connection with the accompanying drawings, in which.

DETAILED DESCRIPTION OF THE PREFERRED EMBODIMENTS

Prior to the description of the preferred embodiments of the present invention, the function of the present invention will be explained.

In general, diamond has a high temperature resistance and a high breakdown voltage. Accordingly, cold cathode emitter elements of the present invention having an emitter portion made of a semiconducting diamond has the following advantages: first, the shape of the tip of the emitter portion is less liable to be changed, thereby lengthening the service life and suppressing the deterioration of the electron emission characteristics; second, a high voltage can be applied to the emitter portion, thereby enabling the operation with a large current. Further, diamond has such a preferable characteristic that, in the (111) crystalline face thereof, the vacuum level lies below the conduction band, so that electrons once excited to the conduction band can be released in vacuum. Such a characteristic is found only in diamond. Therefore, diamond is a highly preferable material for constituting the emitter portion.

Incidentally, diamond can be deposited on a substrate by vapor phase synthesis, and has the following advantage as compared with silicon: the structure of silicon surface is modified at temperatures higher than 200° C. and is thus deteriorated; In contrast, the structure of diamond surface is not modified at least below 600° C. Accordingly, since diamond can be grown on silicon, the emitter portion of silicon in conventional cold cathode emitter elements can be coated with, for example, a semiconducting diamond film to improve the thermal resistance of conventional cold cathode emitter elements. Further, by the use of an insulating diamond film in place of a $SiO_2$ film, it is possible to further improve the thermal resistance and the high frequency characteristic of conventional cold cathode emitter elements.

Preferred embodiments of the present invention will be described hereinafter.

[EXAMPLE 1]

Figure 1:
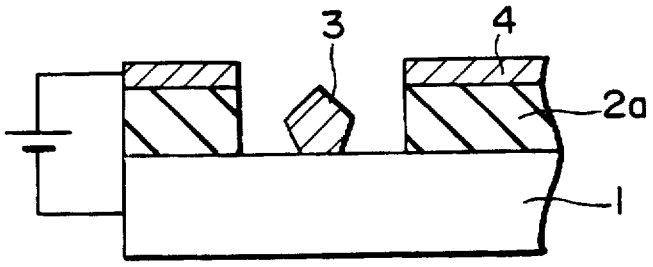
FIG. 1 is a cross-sectional view of a typical cold cathode emitter element according to a first example of the present invention.

FIG. 1 is a cross-sectional view of a typical cold cathode emitter element according to this example of the present invention. In the figure, a $SiO_2$ film 2*a* selectively formed with a pinhole is formed on a low resistance silicon substrate 1, and an emitter 3 made of a semiconducting diamond particle is formed on the substrate inside the pinhole. A leading electrode 4 made of tungsten (W) is formed on the $SiO_2$ film 2*a*.

In this example, the emitter 3 is made of the semiconducting diamond, and thus has a high thermal resistance. Accordingly, it is possible to suppress the deterioration of the curvature of the tip of the emitter 3 during the operation of the element, and hence to avoid the deterioration of the electron emission characteristics. Also, since diamond has a higher breakdown voltage than Si and other materials, the emitter element of the present invention can be operated with a higher electric power than the conventional one.

The above emitter element was fabricated in the following procedure: Semiconducting diamond particles doped with boron (B) were selectively grown on a silicon substrate 1, to thus form an emitter 3. A $SiO_2$ film 2*a* was then formed on the substrate 1 other than the emitter formation area using a photolithography technique. Subsequently, a tungsten thin film as a leading electrode 4 was formed on the $SiO_2$ film 2*a* around the emitter 3.

In the emitter element thus fabricated, the diameter of the cavity was 8 μm, the depth was 3 μm, and the diameter of the emitter 3 was approximately 1 μm. A negative voltage of 300V was applied to an array of the emitter 3 through the substrate 1 in vacuum, as a result of which a current of 2 mA was observed.

[EXAMPLE 2]

Figure 2:
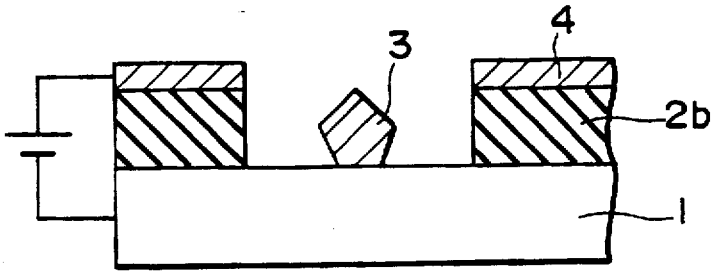
FIG. 2 is a cross-sectional view of a typical cold cathode emitter element according to a second example of the present invention.

FIG. 2 is a cross-sectional view of a typical cold cathode emitter element in this example of the present invention. This example is substantially similar to Example 1, except that an insulating diamond film 2*b* is formed in place of the $SiO_2$ film. Accordingly, in FIG. 2, parts corresponding to those previously described in FIG. 1 are indicated at the same numerals and the explanation thereof is omitted.

In this example, an insulating diamond film 2*b* is formed so as to electrically insulate the emitter 3 from a leading electrode 4. Consequently, this example is effective to enhance the thermal resistance and to improve the high-frequency characteristics as compared with Example 1.

The above emitter element was actually fabricated, in which the diameter of the cavity was approximately 8 μm, the depth was approximately 3 μm, and the diameter of the emitter 3 was approximately 1 μm. A negative voltage of 300V was applied to an array of the emitter 3 through the substrate 1 in vacuum, as a result of which a current of approximately 2 mA was observed.

[EXAMPLE 3]

Figure 3:
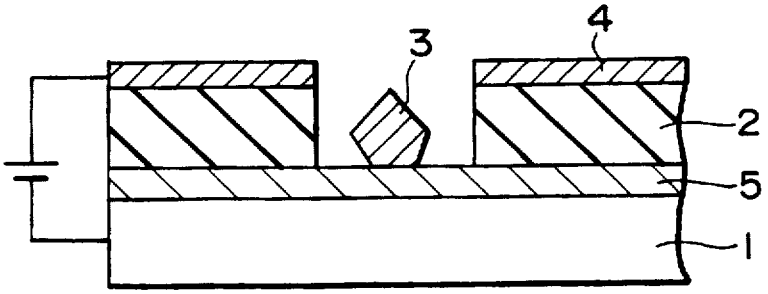
FIG. 3 is a cross-sectional view of a typical cold cathode emitter element according to a third example of the present invention.

FIG. 3 is a cross-sectional view of a typical cold cathode emitter element in this example of the present invention. In this example, a semiconducting diamond film 5 is formed on a low resistance silicon substrate 1. An insulating film 2 selectively provided with a pinhole is formed on the semiconducting diamond film 5, and an emitter 3 made of a semiconducting diamond is formed on the substrate 1 inside the above pinhole. The insulating film 2 may be made of, for example, a $SiO_2$ film or an insulating diamond film. Also, a leading electrode 4 made of tungsten is formed on the insulating film 2.

As mentioned above, the surface of silicon is significantly modified at temperatures higher than 200° C.; however, the surface structure of diamond is unchanged at least up to 600° C. Accordingly, this example is effective to enhance the thermal resistance as compared with Example 1.

The above emitter element was actually fabricated, in which the diameter of the cavity was 8 μm, the depth was 3 μm, and the diameter of the emitter was approximately 1 μm. A negative voltage of 300V was applied to the emitter 3 through the substrate, as a result of which a current of approximately 2 mA was observed.

[EXAMPLE 4]

Figure 4:
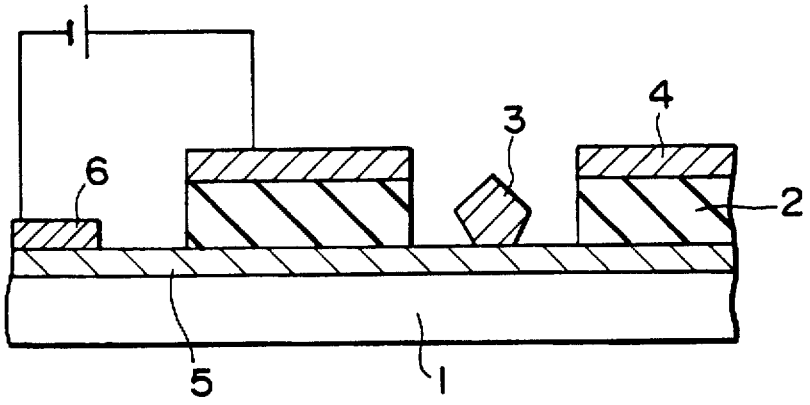
FIG. 4 is a cross-sectional view of a typical cold cathode emitter element according to a fourth example of the present invention.

FIG. 4 is a cross-sectional view of a typical cold cathode emitter element in this example of the present invention. In this example, a substrate 1 is made of an insulating material having a high thermal resistance such as $SiO_2$ or $SiN_4$. A semiconducting diamond film 5 is formed on the substrate 1. An insulating film 2 with a pinhole is formed on the semiconducting diamond film 5. The insulating film 2 may be made of, for example, a $SiO_2$ film or an insulating diamond film. A metal film as a leading electrode 4 is formed on the insulating film 2. Also, an electrode 6 is formed on the semiconducting diamond film 5.

Since the substrate 1 is made of a material having a high thermal resistance, this example is effective to further enhance the thermal resistance as compared with Example 3.

[EXAMPLE 5]

Figure 5:
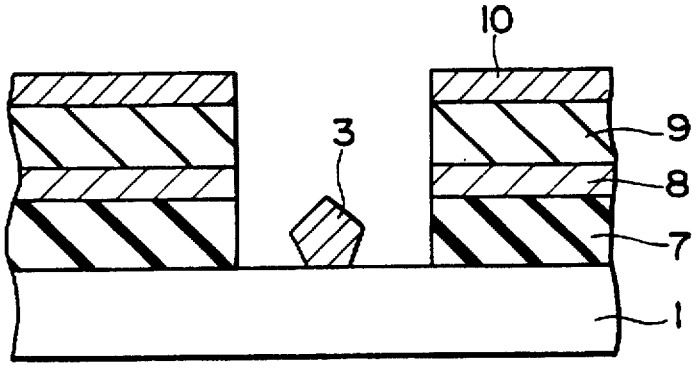
FIG. 5 is a cross-sectional view of a typical vertical vacuum triode element according to a fifth example of the present invention.

FIG. 5 is a cross-sectional view of a typical vertical vacuum triode element according to this example of the present invention. In this example, an insulating film 7 with a specified pinhole is formed on a low resistance silicon substrate 1. An emitter 3 made of a semiconducting diamond is formed on the substrate 1 inside the pinhole. Also, a gate electrode 8 is formed on the insulating film 7, and an insulating film 9 is formed on the gate electrode 8. Further, a drain electrode 10 is formed on the insulating film 9.

Figure 15:
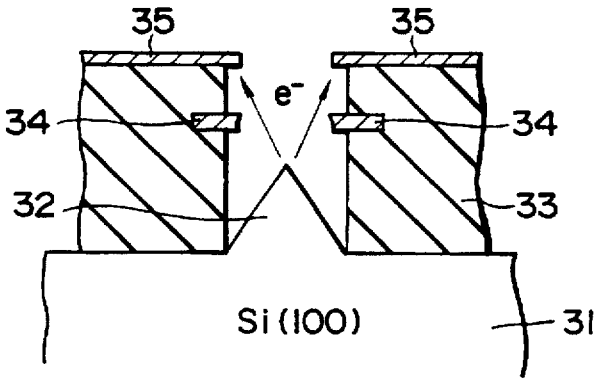
FIG. 15 is a cross-sectional view showing a conventional vertical vacuum triode element with an open cavity using a field emission emitter.
Figure 16A:
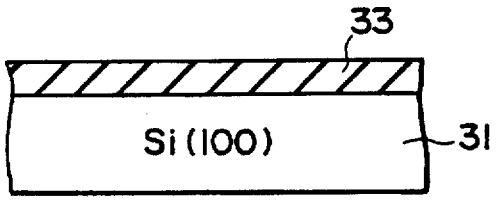
FIGS. 16*a* to 16*e* are cross-sectional views showing a method of fabricating the vertical vacuum triode element shown in FIG. 15.
Figure 16B:
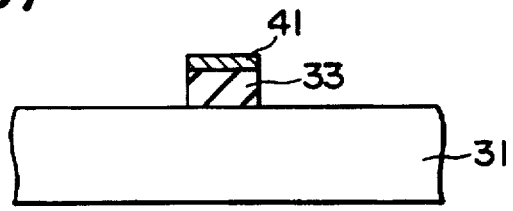
Figure 16C:
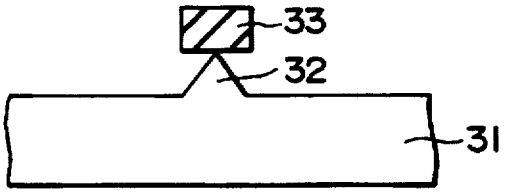
Figure 16D:
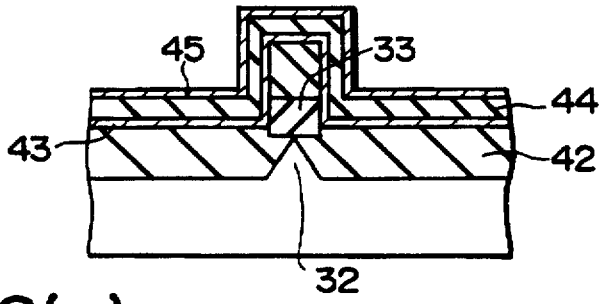
Figure 16E:
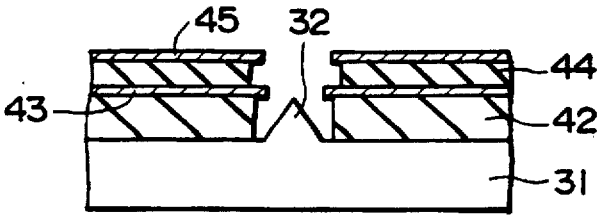

Since the emitter 3 is made of a semiconducting diamond, this example is effective to suppress the deterioration of the electron emission characteristics, to lengthen the service life, and to enable the operation with a high electric power, as compared with the conventional one shown in FIG. 15.

Furthermore, similarly to Examples 3 and 4, the thermal resistance of the cold cathode emitter element can be improved by forming a semiconducting diamond film on the substrate, and then forming an emitter and an insulating film and the like on the semiconducting diamond. Also, by the use of insulating diamonds as the insulating films 7 and 9, the thermal resistance can be further improved.

[EXAMPLE 6]

Figure 6A:
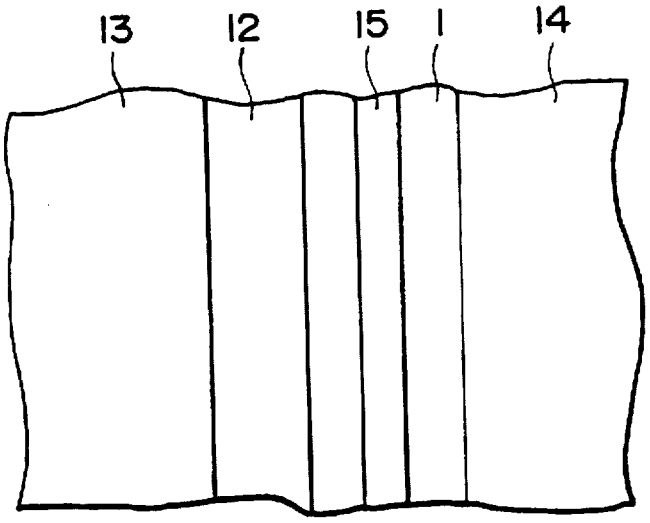
FIG. 6*a* is a plan view of a planar vacuum triode element according to a sixth example of the present invention.
Figure 6B:
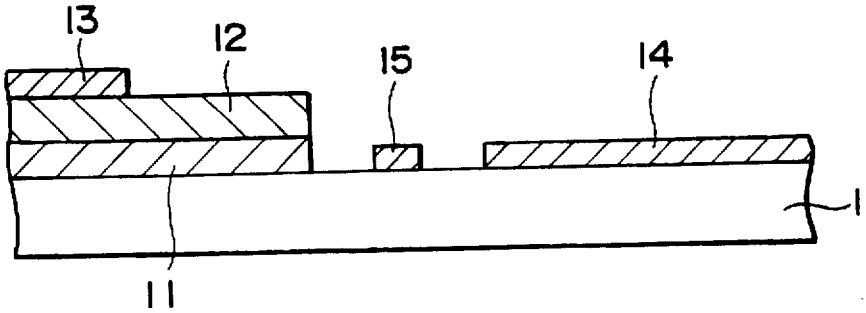
FIG. 6*b* is a cross-sectional view of FIG. 6*a;*

FIG. 6*a* is a plan view of a planar vacuum triode element according to this example of the present invention, and FIG. 6*b* is a cross-sectional view of FIG. 6*a*. In this example, a strip-like gate electrode 15 is formed on an insulating substrate 1, and a diamond film 11 (insulating) and a drain electrode 14 are disposed in such a manner as to put the gate electrode 15 therebetween. Also, a semiconducting diamond film 12 as an emitter is formed on the diamond film 11, and a source electrode 13 is formed on the semiconducting film 12.

In this example, when the specified voltages are applied to the source electrode 13, the gate electrode 15 and the drain electrode 14, electrons are emitted from the semiconducting diamond film 12 in the direction along the substrate surface. The same effect as in Example 6 can be obtained in this example.

[EXAMPLE 7]

Figure 7:
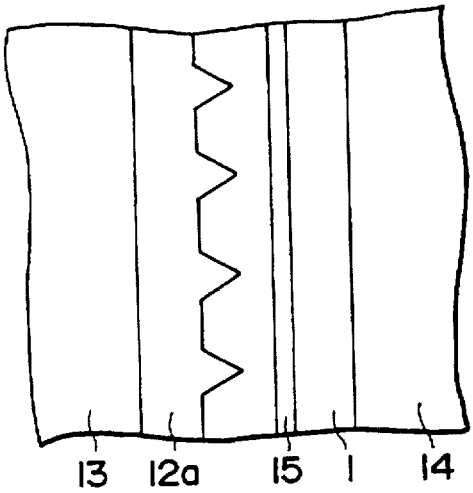
FIG. 7 is a plan view of a planar vacuum triode element according to a seventh example of the present invention.

FIG. 7 is a plan view of a planar vacuum triode element according to this example of the present invention. This example is substantially similar to Example 6, except that a semiconducting diamond film 12*a* is formed into a comb-shape as seen from the top. Accordingly, in FIG. 7, parts corresponding to those previously described in FIG. 6 are indicated at the same numerals and the explanation thereof is omitted.

Since the semiconducting diamond film (emitter) 12*a* is formed into a comb-shape as seen from the top thereby concentrating the electric field at the leading edge thereof, this example is effective to facilitate the emission of electrons from the emitter and to enhance the field emission characteristic, as compared with Example 6.

[EXAMPLE 8]

Figure 8:
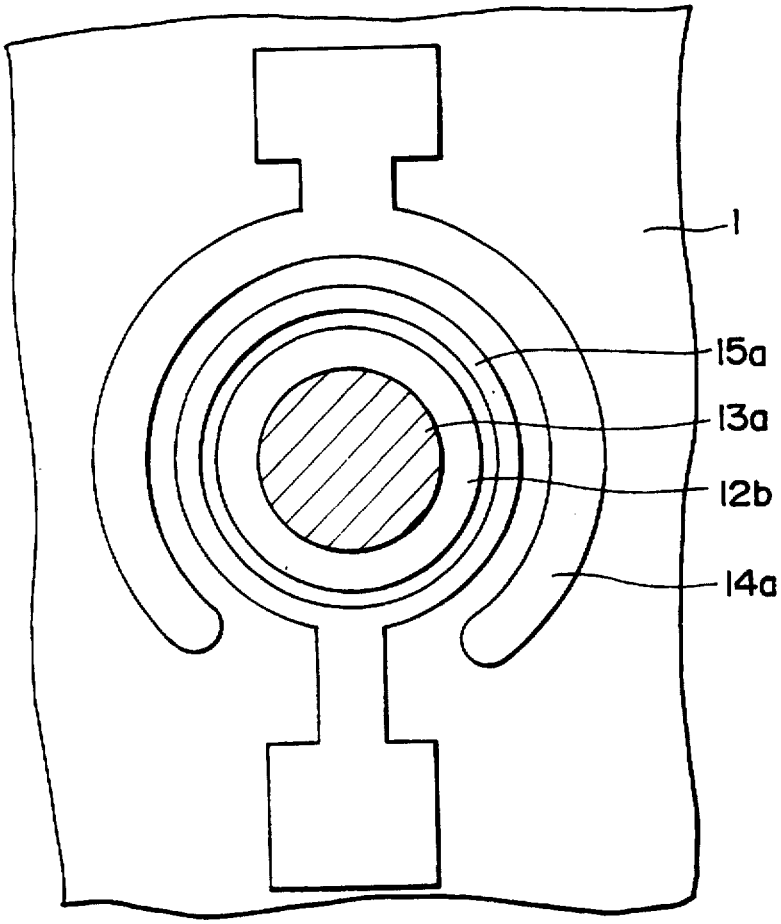
FIG. 8 is a plan view of a vacuum triode element according to an eighth example of the present invention.

FIG. 8 is a plan view of a vacuum triode element according to this example of the present invention. In this example, a circular semiconducting diamond film 12*b* as an emitter is formed in a specified area of an insulating substrate 1. A source electrode 13*a* is formed on the semiconducting diamond film 12*b*. A gate electrode 15*a* is disposed around the semiconducting diamond film 12*b*, and a drain electrode 14*a* is provided around the gate electrode 15*a*. The same effect as in Example 6 can be obtained in this example.

[EXAMPLE 9]

Figure 9A:
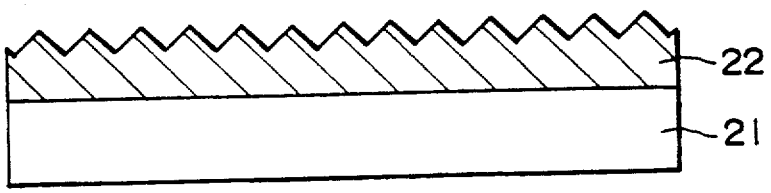
FIGS. 9*a* to 9*d* is a cross-sectional view showing a method for fabricating a cold cathode emitter element according to a ninth example of the present invention in the order of the processes.

FIGS. 9*a* to 9*d* are cross-sectional views showing a method for fabricating a cold cathode emitter element according to this example of the present invention in the order of the processes. The cold cathode emitter element of the present invention was fabricated in the following procedure:

A semiconducting diamond film 22 was deposited on a low resistance silicon substrate 21 by vapor phase synthesis (see FIG. 9*a*).

Figure 9B:
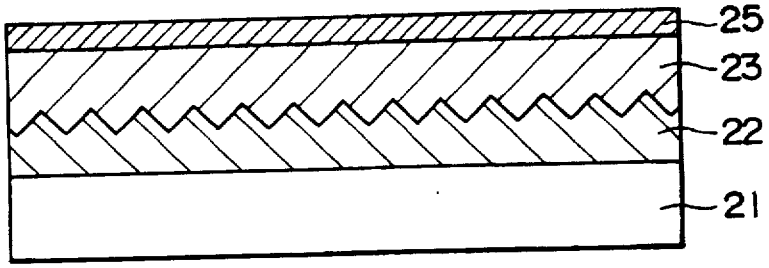
Figure 9C:
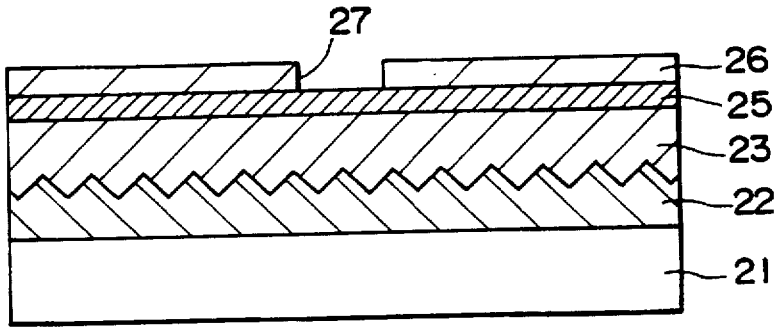

An insulating film 23 (for example, a $SiO_2$ film) was formed uniformly to a thickness of approximately 2 μm, and a metal electrode (anode) 25 was then deposited on the insulating film 23 (see FIG. 9*b*).

A photoresist film 26 was formed, and then a pinhole 27 in a circular or rectangular shape having a diameter or one side of approximately 1.5 μm, was formed on the resist film 26. After that, a metal electrode 25 and an insulating film 23 were selectively etched through the pinhole 27 (see FIG. 9*c*).

Figure 9D:
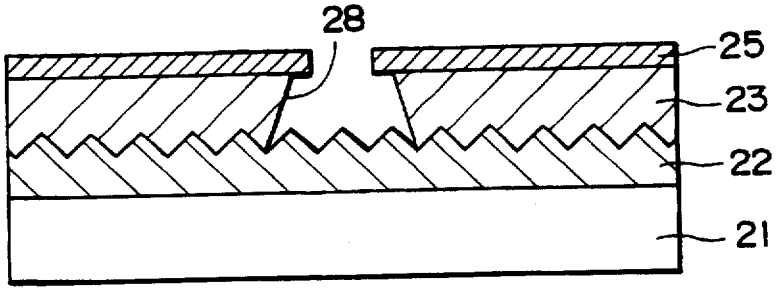

A photoresist 26 as a mask was removed, to thus obtain a cold cathode element (see FIG. 9*d*). In addition, since the surface of the polycrystalline synthetic diamond film 22 is rough as shown in the figures, this example eliminates the necessity of forming the diamond emitter portion by selective etching as shown in Examples 1 to 5.

In the emitter element thus obtained, a negative voltage of 30V was applied across the silicon substrate 21 and the anode in vacuum, as a result of which a current of approximately 2 μmA was observed.

[EXAMPLE 10]

Figure 10:
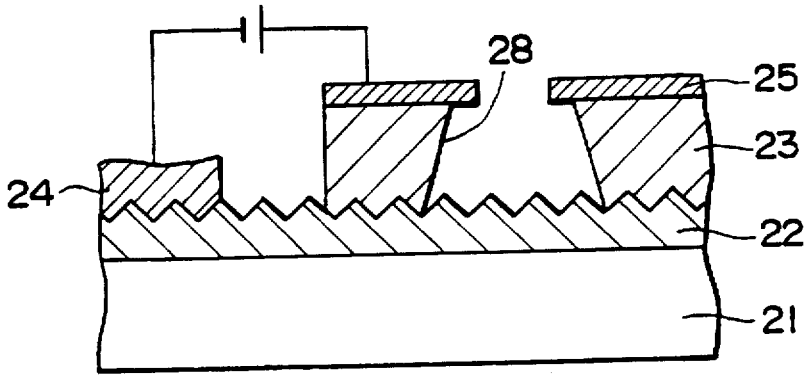
FIG. 10 is a cross-sectional view of a cold cathode emitter element according to a tenth example of the present invention.

FIG. 10 is a cross-sectional view of a cold cathode emitter element according to this example of the present invention. In this example, a substrate 21 is made of an insulating material having a high thermal resistance such as $SiO_2$ or $Si_3O_4$. A semiconducting diamond film 22 is formed on the substrate 21. An insulating film 23 selectively provided with a pinhole 28 is formed on the semiconducting diamond film 22. A leading electrode 25 made of a metal film is formed on the insulating film 23. Further, on a portion of the semiconducting film 22 where the insulating film 23 is not formed, an electrode 24 is selectively formed so as to be brought in electric-contact therewith.

In this example, when a voltage is applied across the leading electrode 25 and the electrode 24 in vacuum such that the electrode 24 becomes negative, electrons are moved in vacuum between the diamond film 22 and the leading electrode 25 inside the pinhole 28, thus performing the specified operation of the cold cathode emitter element.

[EXAMPLE 11]

Figure 11:
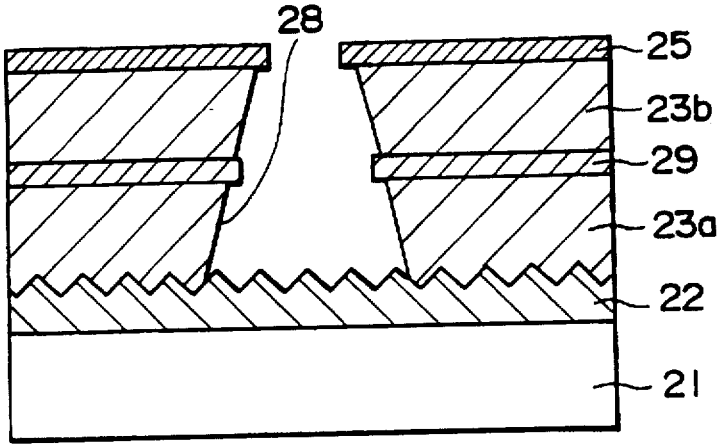
FIG. 11 is a cross-sectional view of a typical vacuum triode element according to an eleventh example of the present invention.
Figure 12:
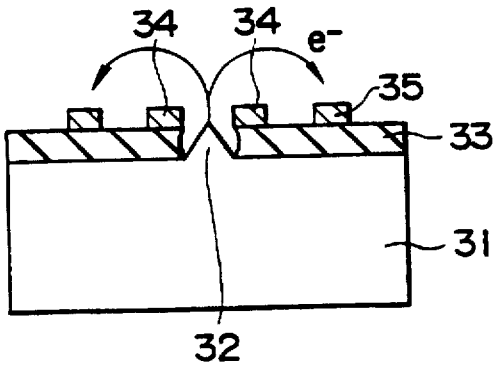
FIG. 12 is a cross-sectional view of a conventional vacuum triode element.
Figure 13A:
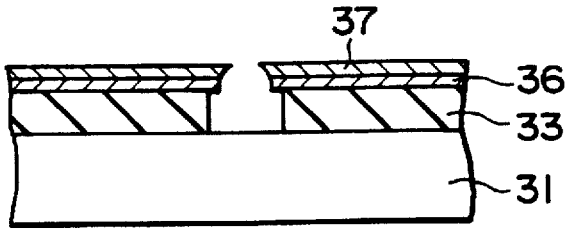
FIGS. 13*a* to 13*c* are cross-sectional views showing a method of fabricating the cold cathode emitter element shown in FIG. 12 in the order of the processes.
Figure 13B:
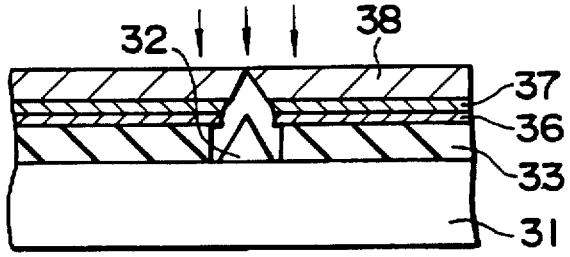
Figure 13C:
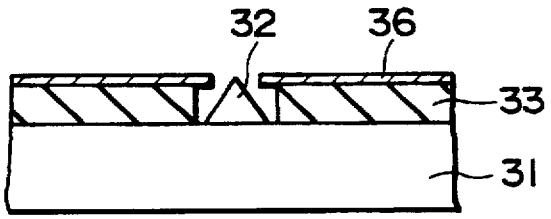
Figure 14A:
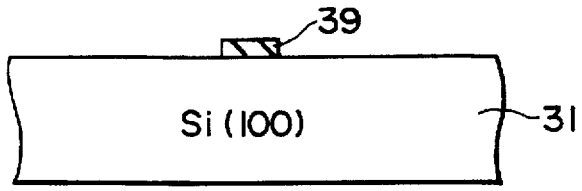
FIGS. 14*a* to 14*c* are cross-sectional views showing another method of fabricating the cold cathode emitter element shown in FIG. 12 in the order of the processes.
Figure 14B:
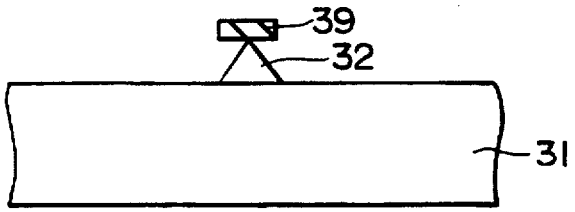
Figure 14C:
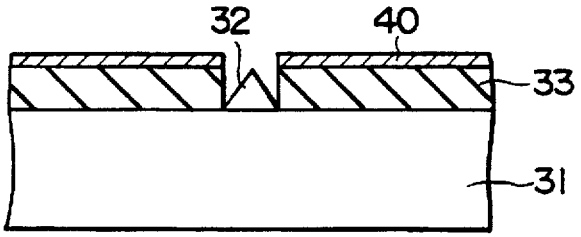

FIG. 11 is a typical cross-sectional view of a vertical vacuum triode element according to this example of the present invention. In this example, a semiconducting diamond film 22 is formed on a low resistance silicon substrate 21, and an insulating film 23*a* having a pinhole is formed thereon. A gate electrode 29 is formed on the insulating film 23*a*, and an insulating film 23*b* is formed on the gate electrode 29. Further, a drain electrode 25 is deposited on the insulating film 23*b*.

Since the emitter is made of diamond, this example is effective to suppress the deterioration of the electron emission characteristics, to lengthen the service life, and to enable the operation with a high electric power, as compared with the conventional one shown in FIG. 15.

In addition, similarly to Example 10, for further enhancing the thermal resistance, the vertical vacuum triode element may be fabricated by forming a semiconducting diamond film on an insulating substrate such as $SiO_2$ or $Si_3N_4$, and then selectively forming a metal electrode (cathode) on the semiconducting diamond film.

As mentioned above, according to the present invention, the emitter portion is made of the semiconducting diamond, and is thus excellent in the thermal resistance and the breakdown voltage. Accordingly, the cold cathode emitter element of the present invention is effective to suppress the change in the shape of the emitter, to suppress the deterioration of the electron emission characteristics, and to enable the operation with a large current. Therefore, the present invention is highly useful in improvement of vacuum microelectronics.

What is claimed is:

1. A cold cathode emitter element comprising:

a substrate;

an emitter portion formed on the substrate for emitting electrons from the surface thereof into vacuum;

an electrode electrically isolated from said emitter portion; and an insulating film electrically insulating said substrate and said electrode, wherein said electrode is disposed on said insulating film, said emitter portion consists of a polycrystalline semiconducting diamond film, said substrate comprises an insulating material, and said insulating film comprises a diamond film.

2. The cold cathode emitting element of claim 1, wherein said substrate comprises a diamond film and a low resistance silicon layer, said diamond film being formed on said low resistance silicon layer.

3. The cold cathode emitting element of claim 1 wherein said insulating film consists of an insulating diamond film.

4. A cold cathode emitter element of claim 1, wherein said substrate further comprises a semiconducting layer.

5. A cold cathode emitter element comprising:

a substrate;

an emitter portion formed on the substrate for emitting electrons from the surface thereof into vacuum;

an electrode electrically isolated from said emitter portion; and an insulating film electrically insulating said substrate and said electrode, wherein said electrode is disposed on said insulating film, said emitter portion is made of a semiconducting diamond particle or film, and said substrate comprises an insulating material, said insulating film comprises a diamond film, said substrate being comprised of a semiconducting diamond film formed on an insulating material, said emitter portion being formed on said semiconducting diamond film, and a contact formed on said semiconducting diamond film.

6. The cold cathode emitter element of claim 5, wherein said insulating material is comprised of a material having a high thermal resistance.

* * * * *